US005764000A

United States Patent [19]

Mougin et al.

[11] Patent Number: 5,764,000

[45] Date of Patent: Jun. 9, 1998

[54] FLAT DISPLAY SCREEN INCLUDING RESISTIVE STRIPS

[75] Inventors: Stéphane Mougin, Grenoble; Francis Courreges, Trets; Jean-Marc Sol, Montpellier, all of France

[73] Assignee: Pixtech S.A., Rousset, France

[21] Appl. No.: 615,041

[22] Filed: Mar. 12, 1996

[30] Foreign Application Priority Data

Mar. 22, 1995 [FR] France ..... 95 03571

[51] Int. Cl.[6] ..... H01J 1/62

[52] U.S. Cl. ..... 313/496; 313/466; 313/311; 315/169.1; 345/75

[58] Field of Search ..... 313/495, 496, 313/497, 466, 470, 461, 467, 473, 311; 315/169.1; 345/74, 75

[56] References Cited

U.S. PATENT DOCUMENTS

| | | | |
|---|---|---|---|
| 4,084,114 | 4/1978 | Kuroda et al. | 313/496 |
| 4,135,117 | 1/1979 | Dubois | 313/496 |
| 4,149,148 | 4/1979 | Kishino | 313/497 |
| 4,720,655 | 1/1988 | Katsuhiro et al. | 313/422 |
| 5,063,327 | 11/1991 | Brodie et al. | 313/495 |
| 5,278,544 | 1/1994 | Leroux | 313/495 |
| 5,378,962 | 1/1995 | Gray et al. | 313/495 |
| 5,592,056 | 1/1997 | Peyre et al. | 313/496 |

OTHER PUBLICATIONS

*Patent Abstracts Of Japan*, vol. 009, No. 118 (E-316), 23 May 1985 & JP-A-60 009039 (Ise Denshi Kogyo KK) 18 Jan. 1985.

*Primary Examiner*—Michael Horabik
*Assistant Examiner*—Michael Day
*Attorney, Agent, or Firm*—Plevy & Associates

[57] ABSTRACT

An anode (5) for a flat display screen includes at least one group of phosphor strips (7) deposited over corresponding electrode strips (17) separated one from another by an insulating layer (8) etched out in front of the phosphor strips (7), and at least one conductor (21) interconnecting the electrode strips (17) of the group of phosphor strips (7). Each of the electrode strips (17) is formed by a resistive strip (18) for receiving one phosphor strip (7) and at least one biasing strip (19) which is parallel to and joins the interconnecting conductor (21). The biasing strip (19) has a low resistivity with respect to the resistivity of the associated resistive strip (18). The biasing strip (19) is parallel to, laterally borders, and is in contacting engagement with the resistive strip (18). The anode (5) eliminates the risk of electrical arcs between the anode (5) and gate (3) or between adjacent phosphor strips (7) of the anode (5), without impairing the brightness of the screen.

10 Claims, 3 Drawing Sheets

FLAT DISPLAY SCREEN INCLUDING RESISTIVE STRIPS

BACKGROUND OF THE INVENTION

1. Field of the Invention

The present invention relates to anodes for flat display screens. It more particularly relates to the realization of connections of luminescent elements of an anode for color screens such as color screens including microtips.

2. Discussion of the Related Art

FIG. 1 represents the structure of a flat display screen with microtips of the type used according to the invention.

Such microtip screens are mainly constituted by a cathode 1 including microtips 2 and by a gate 3 provided with holes 4 corresponding to the positions of the microtips 2. Cathode 1 is disposed so as to face a cathodoluminescent anode 5, formed on a glass substrate 6 that constitutes the screen surface.

The operation and the detailed structure of an example of such a microtip screen are described in U.S. Pat. No. 4,940,916 assigned to Commissariat à l'Energie Atomique.

The cathode 1 is disposed in columns and is constituted, onto a glass substrate 10, of cathode conductors arranged in meshes from a conductive layer. The microtips 2 are disposed onto a resistive layer 11 that is deposited onto the cathode conductors and are disposed inside meshes defined by the cathode conductors. FIG. 1 partially represents the inside of a mesh, without the cathode conductors. The cathode 1 is associated with the gate 3 which is arranged in rows. The intersection of a row of gate 3 with a column of cathode 1 defines a pixel.

This device uses the electric field generated between the cathode 1 and gate 3 so that electrons are transferred from microtips 2 toward phosphor elements 7 of anode 5. In color screens, the anode 5 is provided with alternate phosphor strips **7*r*, 7*b*, 7*g*, each corresponding to a color (red, blue, green). The strips are separated one from the other by an insulating material 8**.

The phosphor elements 7 are deposited onto electrodes 9, which are constituted by corresponding strips of a transparent conductive layer such as indium and tin oxide (ITO).

The groups of red, blue, green strips are alternatively biased with respect to cathode 1 so that the electrons extracted from the microtips 2 of one pixel of the cathode/gate are alternatively directed toward the facing phosphor elements 7 of each color.

The control of the phosphor element 7 (the phosphor element **7*g* in FIG. 1) that should be bombarded by electrons from the microtips 2 of cathode 1 requires to selectively control the biasing of the phosphor elements 7 of anode 5**, for each color.

FIG. 2 schematically illustrates an anode structure of a conventional color television screen. FIG. 2 partially represents a perspective view of an anode 5 fabricated according to known techniques. The anode electrode strips 9, deposited on substrate 6, are interconnected outside the useful area of the screen, for each color of phosphor elements, in order to be connected to a control device (not shown). Two interconnection paths 12 and 13 of anode electrodes **9*g* and 9*b*, respectively, are achieved for two of the three colors of phosphor elements. An insulating layer 14 (represented in dotted lines in FIG. 2) is deposited on the interconnection path 13. A third interconnection path 15 is connected, through conductors 16 deposited on the insulating layer 14, to the strips of anode electrodes 9*r*** designed for the phosphor elements of the third color.

Generally, the rows of gate 3 are sequentially biased at a voltage of approximately 80 volts whereas the phosphor strips (for example **7*g* in FIG. 1) that must be excited are biased at a voltage of approximately 400 volts, the other strips (for example 7*r* and 7*b* in FIG. 1) are at zero. The columns of cathode 1, whose potential determines for each row of gate 3** the brightness of the pixel defined by the intersection of the cathode column and the gate row in the considered color, are brought to respective voltages ranging between a maximum emission potential and a zero-emission potential (for example, 0 and 30 volts respectively).

The values of the biasing voltages are determined by the characteristics of the phosphor elements 7 and microtips 2.

Conventionally, below a voltage difference of 50 volts between the cathode and the gate, no electron emission occurs, and the maximum emission used corresponds to a voltage difference of 80 volts.

The voltage difference between the anode and the cathode depends on the inter-electrode gap. For increasing the brightness of the screen a maximum voltage difference is desired, which requires an inter-electrode gap as wide as possible.

However, the structure of the inter-electrode gap, which includes spacers (not shown) that may generate shadow areas on the screen if they are over-sized, prevents this inter-electrode gap from being increased. Therefore, the inter-electrode gap of a conventional screen is approximately 0.2 mm. This makes it necessary to select an anode-cathode voltage which is critical as regards the formation of electric arcs. Thus destroying electric arcs can occur due to the slightest irregularity of the distance separating a microtip, or the gate layer, from the phosphor elements of the anode. Furthermore, such irregularities are unavoidable because of the small size of the components and the techniques used to fabricate the anode and the cathode-gate.

On the side of the cathode, the resistive layer 11 limits the formation of destroying short-circuits between the microtips and the gate.

However, on the anode side, electric arcs may occur between the gate 3 and the anode phosphor elements 7 which are biased so as to attract the electrons emitted by the microtips 2 (for example, the phosphors **7*g* in FIG. 1). Electric arcs can also occur between two adjacent phosphor strips (for example 7*g* and 7*r* in FIG. 1**) due to the voltage difference between the two strips.

SUMMARY OF THE INVENTION

An object of the invention is to avoid the above drawbacks by providing an anode for a flat display screen which eliminates the risk for electric arcs to occur between the anode and the gate or between two adjacent phosphor strips of the anode, without impairing the brightness of the screen.

To achieve this object, the present invention provides an anode for a flat display screen including at least a group of phosphor strips deposited over strips of corresponding electrodes separated one from the other by an insulating layer including holes facing the phosphor strips, and at least one conductor interconnecting the electrode strips of the group; each electrode strip being formed by a resistive strip for receiving one phosphor strip and at least one first biasing strip which is parallel thereto and joins this interconnection conductor, the biasing strip having a low resistivity with respect to the resistivity of the resistive strip associated therewith.

According to an embodiment of the invention, each resistive strip is bordered by two parallel biasing strips, each biasing strip joining the interconnection conductor.

According to an embodiment of the invention, the resistive strips are in a transparent and electrically conductive non-stoichiometric oxide, the resistivity of the resistive strips being determined by the oxygen ratio of the oxide.

According to an embodiment of the invention, the resistive strips and the biasing strips are made of the same material whose resistivity is higher in a central portion designed to receive the phosphor strips than in lateral areas joining the interconnection conductor.

According to embodiment of the invention, the insulating layer is used as a mask to increase the resistivity of the resistive strips through annealing in an oxygen atmosphere.

According to an embodiment of the invention, the resistivity of the resistive strips is determined by the thickness of the strips.

According to an embodiment of the invention, the insulating layer is used as an etching mask in a process for reducing the thickness of the resistive strips.

According to an embodiment of the invention, the anode includes three groups of alternated resistive strips carrying phosphor elements, each corresponding to one color, and at least three interconnection conductors of the biasing strips associated with the resistive strips of the same color.

According to an embodiment of the invention, all the resistive strips associated with the same interconnection path have the same resistivity.

According to an embodiment of the present invention, the resistive strips are made of indium or tin oxide.

The foregoing and other objects, features, aspects and advantages of the invention will become apparent from the following detailed description of the present invention when taken in conjunction with the accompanying drawings.

BRIEF DESCRIPTION OF THE DRAWINGS

For the sake of clarity, the figures are not drawn to scale and the same elements are designated with the same reference characters in the various figures.

DETAILED DESCRIPTION

Figure 3:
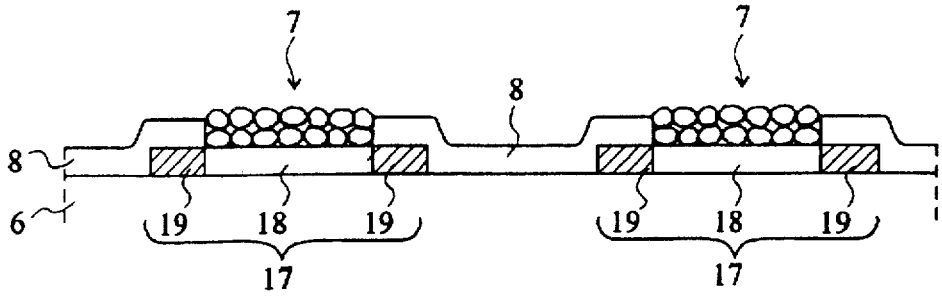
FIG. 3 is a partial cross-sectional view of a first embodiment of an anode according to the invention for a flat display screen.

FIG. 3 is a cross-sectional view of some phosphor strips of the anode of a flat display screen according to a first embodiment of the invention.

A distinctive feature of the present invention is that the strips 17 of anode electrodes each includes a resistive strip 18 supporting phosphor elements 7 and at least one parallel biasing strip 19. Preferably, as represented in the figures, each resistive strip 18 is longitudinally bordered by two biasing strips 19.

Thus, an anode according to the invention is formed, from a transparent substrate 6, for example made of glass, by parallel strips 18 made of an electrically conductive and transparent material, such as indium or tin oxide. Each strip 18 supports a corresponding phosphor strip 7. Each strip 18 is bordered by two lateral highly conductive biasing strips 19, for example made of aluminum, copper or gold. For a color screen, these strips 19 are connected at one of their ends to an interconnection path (not shown) of the phosphor strips 7 of the same color.

A characteristic of the present invention is that the biasing strips 19 are achieved in such a manner that they have a low resistivity with respect to the resistivity of the material constituting the strips 18. Thus, the resistive strips 18 create a lateral access resistance toward each pixel of the screen.

For this purpose, according to this first embodiment, the intrinsic properties of a transparent oxide layer are used. It can be, for example, a layer of indium oxide ($In_2O_x$), tin oxide ($SnO_x$) or indium and tin oxide (ITO).

The thickness and oxygen ratio of the oxide layer are optimized to impart the desired resistance and transparency to each strip 18.

Preferably, the oxide that is used is indium or tin oxide. The use of such an oxide is advantageous in that its resistivity is easily controllable to impart the desired resistance to the strip, because the resistivity of such a strip increases with the oxygen ratio. To increase the resistivity of indium or tin oxide, an annealing step in oxygen atmosphere is carried out at a temperature ranging from 300° to 400° C.

A further advantage of an indium or tin oxide is that it has a better transparency than ITO.

Figure 4:
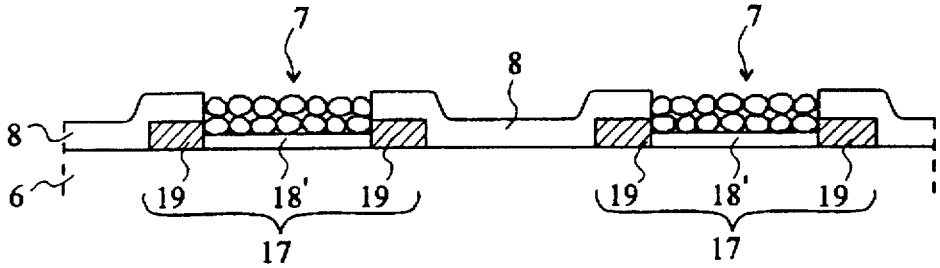
FIG. 4 is a partial cross-sectional view of a second embodiment of an anode according to the invention for a flat display screen.

Preferably, as represented in FIG. 4, a transparent and electrically conductive oxide layer having a reduced thickness, is used to form the resistive strips 18'.

Figure 5:
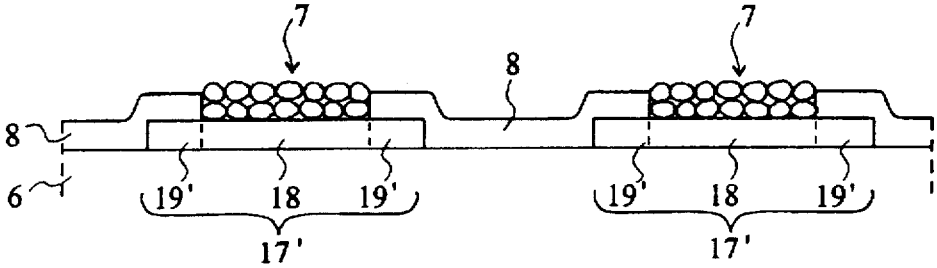
FIG. 5 is a partial cross-sectional view of a third embodiment of an anode according to the invention for a flat display screen.
Figure 6:
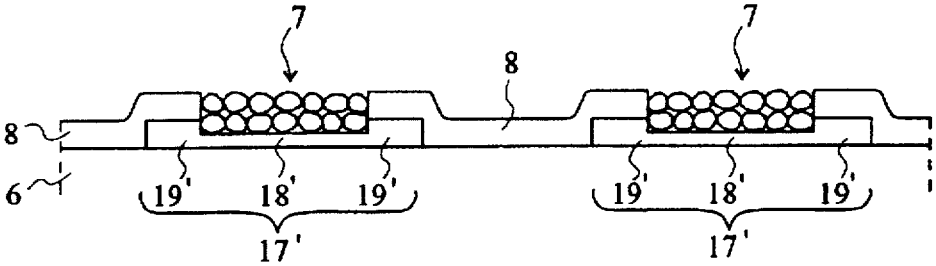
FIG. 6 is a partial cross-sectional view of a fourth embodiment of an anode according to the invention for a flat display screen.

FIGS. 5 and 6 illustrate two further embodiments of an anode according to the invention. According to these embodiments, all the resistive and biasing strips are made of a transparent and electrically conductive oxide.

FIG. 5 is a cross-sectional view of some phosphor strips forming an anode of a flat display screen according to a third embodiment of the invention.

The anode is formed of electrode strips 17' made of a transparent and electrically conductive oxide, whose central portion, having a high resistivity, acts as a resistive strip and is bordered by two lateral areas 19' having a minimum resistivity and acting as biasing strips. The difference in resistivity is obtained by an oxygen ratio that differs for the lateral areas 19' and the central area 18. For this purpose, strips 17' are formed from an oxide layer, for example indium or tin, having a minimum resistivity. Then, the insulating layer 8, for example in silicon oxide, is deposited and etched out in front of the central areas 18 designed to receive the phosphor strips 7. Layer 8 is then used as a mask to increase the resistivity of the central portions 18 by increasing their oxygen ratio, by annealing in an oven in an oxygen atmosphere at a temperature of approximately 400° C. FIG. 6 is a cross-sectional view of some phosphor strips forming an anode of a flat display screen according to a fourth embodiment of the invention.

In this embodiment, the anode is also formed by electrode strips 17' of transparent and electrically conductive oxide, whose central portion 18', having a high resistivity, acts as a resistive strip and is bordered by two lateral areas 19' having a minimum resistivity and acting as biasing strips. In contrast, in this case, the resistivity is identical for the central areas 18' and lateral areas 19' and preferably corresponds to a minimum resistivity. The high resistivity of the central areas 18' is obtained by imparting a small thickness to these areas. The insulating layer 8 is used as an etching mask for etching the central areas 18'.

Figure 7:
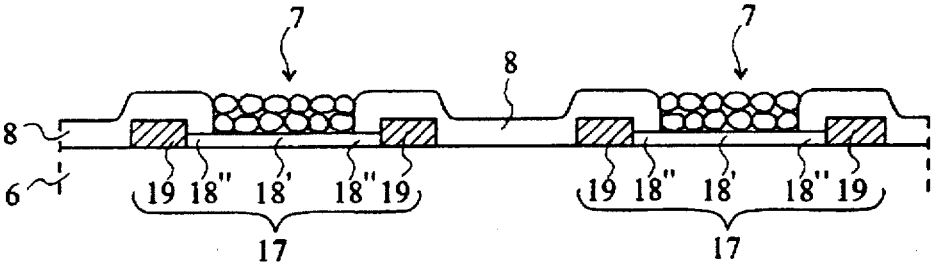
FIG. 7 is a partial cross-sectional view of a fifth embodiment of an anode according to the invention for a flat display screen.

To improve the protection of the phosphor elements nearest to the biasing strips, it is possible, according to a fifth embodiment of the invention represented in FIG. 7, to provide for the insulating layer 8 to overlap the resistive strips. Thus, an intermediate resistive area 18" devoid of phosphor elements and protected by layer 8 is created between the biasing strips and the central areas 18'. Such an overlapping is, for example, achieved by positioning the mask used to define the resistive strips in relation with the mask used to etch layer 8.

In FIG. 7, the biasing strips are metal strips, for example made of aluminum. Lateral areas 19' of oxide strips can also be used as biasing strips as for the embodiments represented in FIGS. 5 and 6.

Of course, all the above described embodiments can be combined in a single electrode strip.

Thus, for example, strips of transparent and electrically conductive oxide, which have a high resistivity in a central areas bordered by biasing strips, for example of aluminum, can be provided. These biasing strips are deposited on oxide lateral areas. The insulating layer, which covers the biasing strips and the lateral areas of conductive and transparent oxide, is still used as an etching mask and/or to increase the oxygen ratio.

Figure 1:
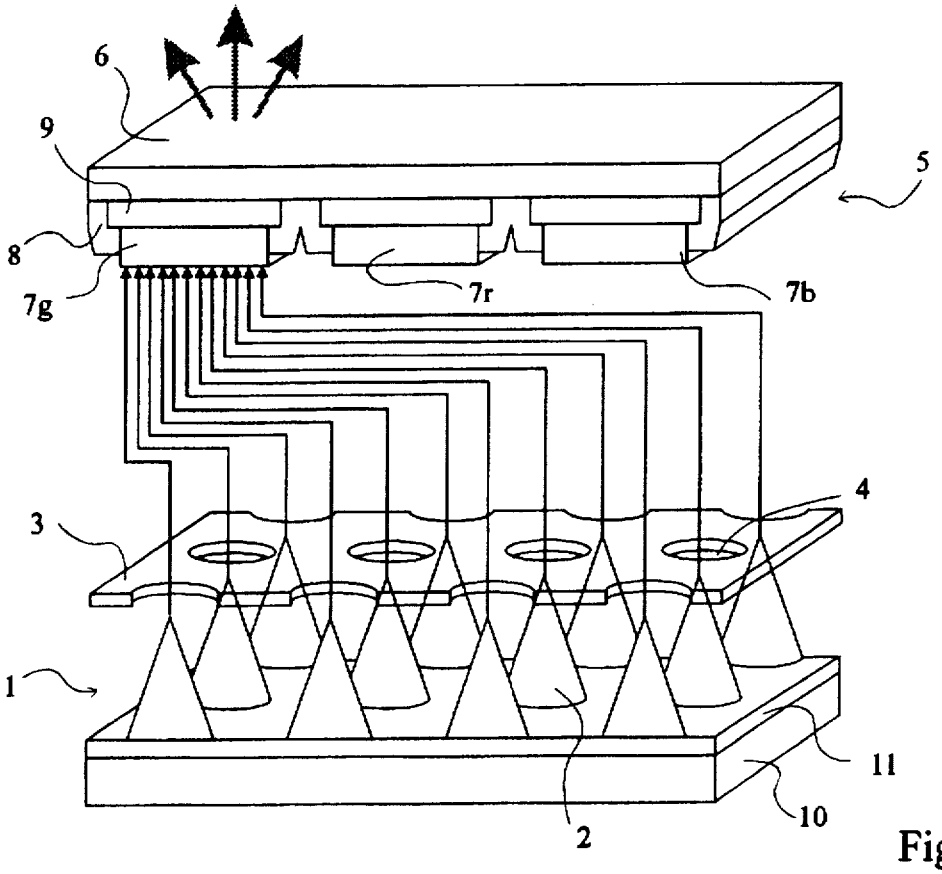
Fig 1 (PRIOR ART)
FIGS. 1 and 2, above described, explain the state of the art and the problem encountered.
Figure 2:
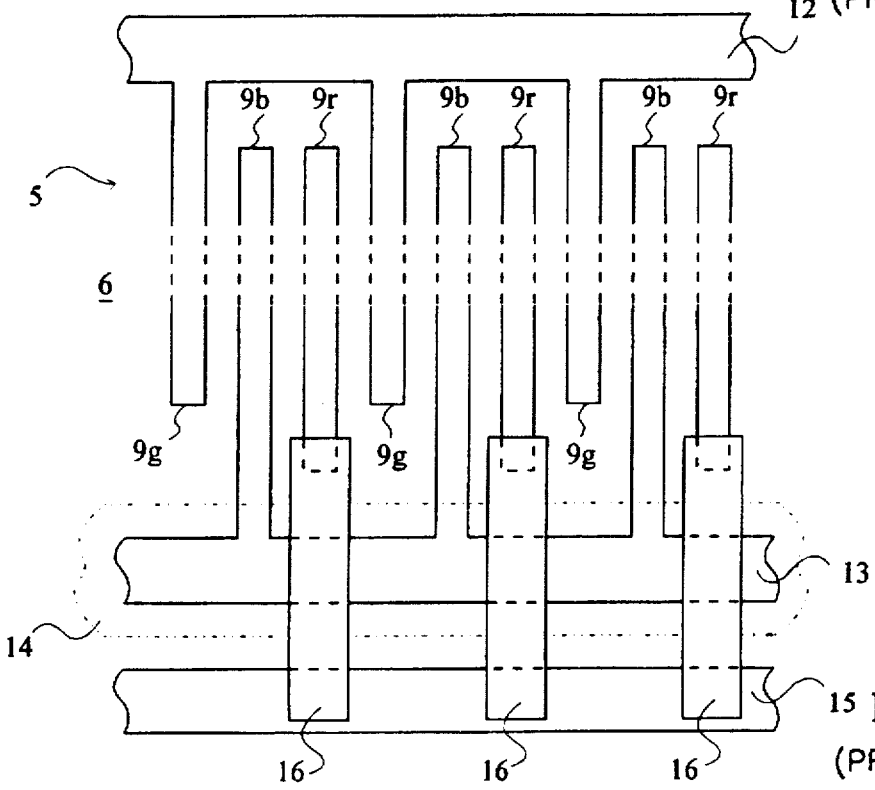
Fig 2 (PRIOR ART)
Figure 8:
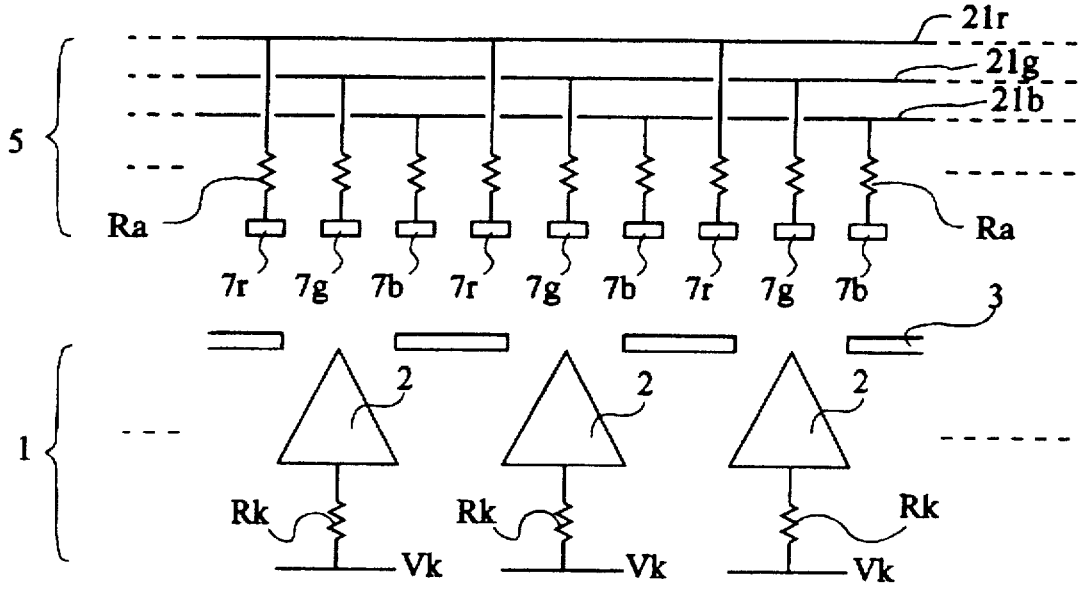
FIG. 8 represents the equivalent electrical diagram of a microtip screen including an anode according to the invention.

The electrical interconnection of the electrode strips 17, or 17', is illustrated in FIG. 8 which represents the electric equivalent diagram of a microtip color screen with an anode according to the invention. This electrical interconnection is similar to that disclosed with relation with FIG. 2, except that the interconnection paths 21 connect the biasing strips 19, or 19', and no longer directly the strips 18, or 18', which receive the phosphor elements 7. Thus, the addressing of an anode according to the invention can be conventionally achieved.

During biasing of a predetermined gate row, each phosphor strip *7r*, *7g* or *7b* is individually protected against electric arcs by a resistance Ra in series between this strip and the interconnection path 21 with which it is associated. The value of resistance Ra formed by the resistive layer 18, or 18', is such that it limits the current in the electrode strip 17 or 17' to a value selected to prevent destroying electric arcs from occurring, without causing an important drop of the anode voltage. Resistance Ra corresponds in fact to the lateral resistances formed by the resistive strips 18, or 18', between the phosphor elements 7 and the biasing strips 19, or 19'.

FIG. 8 represents the microtips of cathode 1 in the form of one microtip 2 for each pixel whereas, in practice there are several thousand microtips per screen pixel. Thus, a resistance Rk, which corresponds to the resistive layer 11 between the cathode conductors and the microtips, is formed. The resistance Rk homogenizes the electron emission of the microtips 2 and prevents electric short-circuits from occurring between the gate 3 and microtips 2. The resistance Ra formed by each resistive strip 18, or 18', is electrically connected in series to this resistance Rk for each pixel.

It should understood that resistance Ra can be selected significantly higher than resistance Rk for a pixel without causing an important voltage drop in the resistive strips, because the biasing voltage (approximately 400 volts) of the anode strips is generally higher than the difference in the gate-cathode potential on which resistance Rk intervenes. The value of resistance Rk is generally approximately 500 kΩ for a biasing voltage of the gate rows of approximately 80 volts and a biasing voltage Vk of the cathode columns ranging from 0 to 30 volts.

By way of a specific example, for a typical current consumption of 10 μA per pixel and for a 400-volt biasing voltage Va of strips 19, or 19', strips 18, or 18', having a resistivity of approximately 200 Ω.cm can be used. Such strips that are formed with a thickness of approximately 50 nm have a layer resistivity of approximately 40 Ω per square. For a pixel having a 300-μm side, this value forms a global resistance Ra of approximately 2 MΩ. This enables to limit the voltage drop in the resistive strip to approximately 20 volts. Such a resistivity value prevents destroying electric arcs from occurring by limiting the current in each strip 19, or 19', to approximately 200 μA, while maintaining the brightness of the screen.

It will be understood that the addition of the resistances Ra does not impair the switching speed of the anode rows since the resistance of the biasing strips remains low (a few kΩ), the product of their resistance by the capacitance of the anode rows (a few nF) corresponds to a time constant much lower than the switching time of the anode (a few milliseconds).

The current limitation, individually for each anode electrode strip, further prevents electric arcs from occurring between two adjacent strips which are at different potentials.

A further advantage of the present invention is that resistance Ra is the same for all the pixels of the screen. Indeed, for a determined pixel, this resistance is independent of the distance separating this pixel from the interconnection path 21, provided that the resistivity of the biasing strips 19, or 19' is low.

As is apparent to those skilled in the art, various modifications can be made to the above disclosed preferred embodiments. More particularly, each constituent described for the layers constituting the anode can be replaced with one or more constituting elements providing the same function.

Furthermore, although the description refers to a color screen, the invention also applies to a mono-color screen having an anode including parallel phosphor strips. The invention also applies to a multicolor screen in which ranges, or sectors, covering several pixels are assigned to one color. The invention further applies to a color screen in which the anode strips are not switched but continuously biased. In this case, a single interconnection path is necessary; however, on the anode side, the pixels are partitioned into sub-pixels, each sub-pixel being assigned to one color and being disposed so as to face the corresponding anode strip.

We claim:

1. An anode (5) for a flat display screen including at least one group of phosphor strips (7) deposited over corresponding electrodes strips separated one from the other by an insulating layer (8) etched out in front of the phosphor strips (7), and at least one conductor (21) interconnecting the electrode strips of said group, wherein each said electrode strip (17, 17') is formed by a resistive strip (18, 18') for receiving one phosphor strip (7) and at least one first biasing strip (19, 19') which is parallel thereto and joins said interconnecting conductor (21), said biasing strip (19, 19') having a low resistivity with respect to the resistivity of said resistive strip (18, 18') associated therewith, wherein said at least one first biasing strip is parallel to and laterally bordering and in contacting engagement with said resistive strip.

2. The anode of claim 1, wherein each resistive strip (18, 18') is bordered by two parallel biasing strips (19, 19'), each biasing strip (19, 19') joining said interconnecting conductor (21).

3. The anode of claim 1, wherein said resistive strips (18, 18') are in a transparent and electrically conductive non-stoichiometric oxide, the resistivity of the resistive strips being determined by the oxygen ratio of the oxide.

4. The anode of claim 1, wherein said resistive strips (18, 18') sand said biasing strips (19') are made of the same material whose resistivity is higher in a central portion (18, 18') designed to receive the phosphor element strips (7) than in lateral areas (19') joining said interconnecting conductor (21).

5. The anode of claim 4, wherein said insulating layer (8) is used as a mask to increase the resistivity of said resistive strips (18) through annealing in an oxygen atmosphere.

6. The anode of claim 4, wherein the resistivity of said resistive strips (18') is determined by the thickness of said strips.

7. The anode of claim 6, wherein said insulating layer (8) is used as an etching mask in a process for reducing the thickness of said resistive strips (18').

8. The anode of claim 1, including three groups of alternated resistive strips (18, 18') carrying phosphor elements (7), each corresponding to one color, and at least three interconnecting conductors (21) of the biasing strips (19, 19') associated with the resistive strips (18, 18') of the same color.

9. The anode of claim 8, wherein all the resistive strips (18, 18') associated with the same interconnection path (21) have the same resistivity.

10. The anode of claim 1, wherein said resistive strips (18, 18') are made of indium or tin oxide.

* * * * *